US008258942B1

(12) United States Patent
Lanzone et al.

(10) Patent No.: US 8,258,942 B1
(45) Date of Patent: Sep. 4, 2012

(54) LIGHTWEIGHT PORTABLE TRACKING DEVICE

(75) Inventors: Michael Lanzone, Rector, PA (US); Casey Halverson, Federal Way, WA (US); Todd Katzner, Glenshaw, PA (US)

(73) Assignee: Cellular Tracking Technologies, LLC, Somerset, PA (US)

( * ) Notice: Subject to any disclaimer, the term of this patent is extended or adjusted under 35 U.S.C. 154(b) by 765 days.

(21) Appl. No.: 12/011,265

(22) Filed: Jan. 24, 2008

(51) Int. Cl.
*G08B 1/08* (2006.01)

(52) U.S. Cl. ..... 340/539.13; 340/572.1; 340/539.1; 340/539.11; 340/506; 340/3.1

(58) Field of Classification Search ..... 340/539.13, 340/572.1, 539.1, 539.11
See application file for complete search history.

(56) References Cited

U.S. PATENT DOCUMENTS

| | | | | |
|---|---|---|---|---|
| 4,731,870 | A | 3/1988 | Black et al. | 455/127.5 |
| 4,761,824 | A | 8/1988 | Saito | 455/127.1 |
| 4,870,698 | A | 9/1989 | Katsuyama et al. | 455/522 |
| 4,903,327 | A | 2/1990 | Raghuram et al. | 455/127.1 |
| 5,031,231 | A | 7/1991 | Miyazaki | 455/574 |
| 5,043,736 | A | 8/1991 | Darnell et al. | 342/357.1 |
| 5,086,290 | A | 2/1992 | Murray et al. | 340/539.13 |
| 5,119,504 | A | 6/1992 | Durboraw, III | 455/556.2 |
| 5,235,633 | A | 8/1993 | Dennison et al. | 455/456.3 |
| 5,338,896 | A | 8/1994 | Danforth | 174/380 |
| 5,353,330 | A | 10/1994 | Fujiwara | 455/563 |
| 5,365,451 | A | 11/1994 | Wang et al. | 701/213 |
| 5,367,309 | A | 11/1994 | Tashjian | 343/702 |
| 5,422,816 | A | 6/1995 | Sprague et al. | 455/556.2 |
| 5,424,688 | A | 6/1995 | Phillips | 331/16 |
| 5,444,866 | A | 8/1995 | Cykiert | 455/575.5 |
| 5,535,439 | A | 7/1996 | Katz | 455/117 |
| 5,564,085 | A | 10/1996 | Chen et al. | 455/117 |
| 5,568,153 | A | 10/1996 | Beliveau | 342/357.1 |
| 5,590,395 | A | 12/1996 | Diekelman | 455/13.1 |
| 5,613,194 | A | 3/1997 | Olds et al. | 455/429 |
| 5,613,221 | A | 3/1997 | Hunt | 455/575.5 |
| 5,625,668 | A | 4/1997 | Loomis et al. | 455/456.5 |
| 5,630,206 | A | 5/1997 | Urban et al. | 455/456.1 |
| 5,669,061 | A | 9/1997 | Schipper | 455/429 |
| RE35,916 | E | 10/1998 | Dennison et al. | 455/456.3 |
| 5,835,846 | A | 11/1998 | Furukawa et al. | 455/10 |
| 5,877,724 | A | 3/1999 | Davis | 342/357.1 |
| 5,913,170 | A | 6/1999 | Wortham | 455/457 |
| 5,929,806 | A | 7/1999 | Birchler et al. | 342/357.08 |

(Continued)

OTHER PUBLICATIONS

Africa Wildlife Tracking, Cellular Collars, downloaded from www.awt.co.za on Sep. 26, 2007.

(Continued)

*Primary Examiner* — Daryl Pope
(74) *Attorney, Agent, or Firm* — Price & Adams

(57) ABSTRACT

A housing holds a microprocessor, a power management system, a pair of communication modules, multiple internal antennas, and a plurality of sensors and interfaces. The housing is connected to a mobile object. One of the communication modules connects to a GPS system through one of the antennas. The other communication module connects to a mobile cellular network or a radio or satellite system through the other antennas. The microprocessor uses the GPS system to determine the position of the object; frequency with which locational fixes are stored is user-determined. The microprocessor can be interactively reprogrammed via the mobile cellular network and creates a data structure for transmission of locational and other environmental data through the mobile cellular or other networks. The microprocessor has the ability to command the unit to separate from the object at an appropriate time to facilitate recovery.

39 Claims, 5 Drawing Sheets

U.S. PATENT DOCUMENTS

| | | | | |
|---|---|---|---|---|
| 5,930,684 | A | 7/1999 | Keskitalo et al. | 455/69 |
| 5,959,529 | A * | 9/1999 | Kail, IV | 340/539.12 |
| 5,995,854 | A | 11/1999 | Wilson | 455/575.5 |
| 6,018,646 | A | 1/2000 | Myllymaki et al. | 455/115.4 |
| 6,029,074 | A | 2/2000 | Irvin | 455/571 |
| 6,072,985 | A | 6/2000 | Wismer | 455/12.1 |
| 6,088,573 | A | 7/2000 | Tsuda | 455/13.4 |
| 6,121,922 | A | 9/2000 | Mohan | 342/357.1 |
| 6,127,945 | A | 10/2000 | Mura-Smith | 340/98 |
| 6,151,508 | A | 11/2000 | Kim et al. | 455/522 |
| 6,166,627 | A | 12/2000 | Reeley | 340/426.25 |
| 6,204,808 | B1 | 3/2001 | Bloebaum et al. | 342/357.07 |
| 6,205,340 | B1 | 3/2001 | Yandrofski et al. | 455/561 |
| 6,222,828 | B1 | 4/2001 | Ohlson et al. | 370/320 |
| 6,236,359 | B1 | 5/2001 | Watters et al. | 342/357.1 |
| 6,249,245 | B1 | 6/2001 | Watters et al. | 342/357.03 |
| 6,249,253 | B1 | 6/2001 | Nielsen et al. | 342/463 |
| 6,253,160 | B1 | 6/2001 | Hanseder | 702/95 |
| 6,263,215 | B1 | 7/2001 | Patton et al. | 455/561 |
| 6,268,824 | B1 | 7/2001 | Zhodzishky et al. | 342/357.04 |
| 6,271,757 | B1 | 8/2001 | Touchton et al. | 340/573.1 |
| 6,292,665 | B1 | 9/2001 | Hildebrand et al. | 455/456.4 |
| 6,298,241 | B1 | 10/2001 | Hong | 455/522 |
| 6,304,748 | B1 | 10/2001 | Li et al. | 455/113 |
| 6,314,277 | B1 | 11/2001 | Hsu et al. | 455/117 |
| 6,314,308 | B1 | 11/2001 | Sheynblat et al. | 455/574 |
| 6,320,535 | B1 | 11/2001 | Hillman et al. | 342/357.1 |
| 6,336,040 | B1 | 1/2002 | Asano et al. | 455/561 |
| 6,347,278 | B2 | 2/2002 | Ito | 701/200 |
| 6,359,216 | B1 | 3/2002 | Liu | 174/357 |
| 6,363,250 | B1 | 3/2002 | Lindell | 455/422.1 |
| 6,408,186 | B1 | 6/2002 | Park et al. | 455/456.1 |
| 6,408,188 | B1 | 6/2002 | Park | 455/466 |
| 6,408,196 | B2 | 6/2002 | Sheynblat et al. | 455/574 |
| 6,469,245 | B2 | 10/2002 | Son | 174/382 |
| 6,473,600 | B1 | 10/2002 | Dvorkin | 455/129 |
| 6,487,420 | B1 | 11/2002 | Jonsson | 455/522 |
| 6,498,565 | B2 | 12/2002 | Boulay et al. | 340/572.1 |
| 6,501,420 | B2 | 12/2002 | Townsend et al. | 342/357.1 |
| 6,505,036 | B2 | 1/2003 | Zilberberg et al. | 455/117 |
| 6,510,142 | B1 | 1/2003 | Kinnavy et al. | 370/311 |
| 6,512,478 | B1 | 1/2003 | Chien | 342/357.09 |
| 6,515,223 | B2 | 2/2003 | Tashjian | 174/388 |
| 6,519,473 | B1 | 2/2003 | Park et al. | 455/522 |
| 6,526,295 | B1 | 2/2003 | Shull | 455/574 |
| 6,542,820 | B2 | 4/2003 | LaMance et al. | 701/213 |
| 6,560,534 | B2 | 5/2003 | Abraham et al. | 701/213 |
| 6,571,110 | B1 | 5/2003 | Patton et al. | 455/561 |
| 6,606,562 | B1 | 8/2003 | Gifford | 701/213 |
| 6,611,229 | B2 | 8/2003 | Muramatsu et al. | 342/357.07 |
| 6,618,596 | B1 | 9/2003 | Uchida | 455/522 |
| 6,643,520 | B1 | 11/2003 | Park et al. | 455/522 |
| 6,657,587 | B1 | 12/2003 | Mohan | 342/357.1 |
| 6,665,541 | B1 | 12/2003 | Krasner et al. | 455/502 |
| 6,678,510 | B2 | 1/2004 | Syrjarinne et al. | 455/255 |
| 6,678,514 | B2 | 1/2004 | Wheeler et al. | 455/404.1 |
| 6,711,387 | B1 | 3/2004 | Lungley | 455/90.3 |
| 6,720,879 | B2 | 4/2004 | Edwards | 340/573.3 |
| 6,731,614 | B1 | 5/2004 | Ohlson et al. | 370/320 |
| 6,744,742 | B1 | 6/2004 | Koskela et al. | 370/318 |
| 6,754,502 | B2 | 6/2004 | Hildebrand et al. | 455/456.4 |
| 6,756,882 | B2 | 6/2004 | Benes et al. | 340/323 R |
| 6,795,699 | B1 | 9/2004 | McCraw et al. | 455/408 |
| 6,798,343 | B2 | 9/2004 | Carrier et al. | 340/539.13 |
| 6,801,129 | B2 | 10/2004 | Grimm | 340/568.7 |
| 6,816,090 | B2 | 11/2004 | Teckchandani et al. | 340/989 |
| 6,819,919 | B1 | 11/2004 | Tanaka | 455/414.1 |
| 6,825,763 | B2 | 11/2004 | Ulrich et al. | 340/539.1 |
| 6,828,936 | B2 | 12/2004 | Odashima et al. | 342/455 |
| 6,829,468 | B2 | 12/2004 | Gandhi et al. | 455/69 |
| 6,833,787 | B1 | 12/2004 | Levi | 340/539.13 |
| 6,838,998 | B1 | 1/2005 | Brown et al. | 340/825.49 |
| 6,850,839 | B1 | 2/2005 | McGibney | 701/207 |
| 6,865,397 | B2 | 3/2005 | Park et al. | 455/522 |
| 6,865,399 | B2 | 3/2005 | Fujioka et al. | 455/553.1 |
| 6,871,144 | B1 | 3/2005 | Lee | 701/213 |
| 6,876,867 | B2 | 4/2005 | Tiedemann, Jr. et al. | 455/522 |
| 6,882,274 | B2 | 4/2005 | Richardson et al. | 340/529.13 |
| 6,889,042 | B2 | 5/2005 | Rousseau et al. | 455/431 |
| 6,891,471 | B2 | 5/2005 | Yuen et al. | 340/539.32 |
| 6,909,907 | B1 | 6/2005 | Oyang et al. | 455/556.1 |
| 6,917,300 | B2 | 7/2005 | Allen | 340/686.6 |
| 6,917,792 | B2 | 7/2005 | Kim | 455/127.5 |
| 6,917,823 | B2 | 7/2005 | Katagishi et al. | 455/571 |
| 6,934,539 | B2 | 8/2005 | Laroia et al. | 455/421 |
| 6,937,640 | B2 | 8/2005 | Yun et al. | 375/141 |
| 6,937,872 | B2 | 8/2005 | Krasner | 455/502 |
| 6,941,197 | B1 | 9/2005 | Murakami et al. | 701/22 |
| 6,954,148 | B2 | 10/2005 | Pulkkinen et al. | 340/572.1 |
| 6,960,997 | B2 | 11/2005 | Gieseke et al. | 340/539.13 |
| 6,961,581 | B2 | 11/2005 | Goto et al. | 455/522 |
| 6,970,726 | B2 | 11/2005 | Takayanagi | 455/574 |
| 6,973,337 | B2 | 12/2005 | Jiguet et al. | 455/574 |
| 6,975,222 | B2 | 12/2005 | Krishan et al. | 340/539.13 |
| 6,980,814 | B2 | 12/2005 | Nohara et al. | 455/456.1 |
| 6,989,741 | B2 | 1/2006 | Kenny et al. | 340/505 |
| 6,992,582 | B2 | 1/2006 | Hill et al. | 340/539.13 |
| 6,992,584 | B2 | 1/2006 | Dooley et al. | 340/540 |
| 6,995,667 | B2 | 2/2006 | He et al. | 340/539.13 |
| 6,998,985 | B2 | 2/2006 | Reisman et al. | 340/573.1 |
| 7,002,489 | B1 | 2/2006 | Denker et al. | 340/988 |
| 7,005,968 | B1 | 2/2006 | Bridgelall | 340/10.42 |
| 7,009,561 | B2 | 3/2006 | Menache et al. | 342/463 |
| 7,015,817 | B2 | 3/2006 | Copley et al. | 340/573.4 |
| 7,019,642 | B2 | 3/2006 | Nelson et al. | 340/539.1 |
| 7,019,644 | B2 | 3/2006 | Barrie | 340/539.13 |
| 7,023,344 | B2 | 4/2006 | Schaper | 340/572.4 |
| 7,024,215 | B2 | 4/2006 | Krasner | 455/502 |
| 7,031,762 | B2 | 4/2006 | Shoji et al. | 455/575.5 |
| 7,038,590 | B2 | 5/2006 | Hoffman et al. | 340/573.1 |
| 7,043,258 | B2 | 5/2006 | Haddrell | 455/456.6 |
| 7,053,824 | B2 | 5/2006 | Abraham | 342/357.1 |
| 7,054,593 | B2 | 5/2006 | de La Chapelle et al. | 455/13.4 |
| 7,054,656 | B2 | 5/2006 | Zhou et al. | 455/522 |
| 7,057,509 | B2 | 6/2006 | Gualdi et al. | 340/539.13 |
| 7,076,265 | B2 | 7/2006 | Tayloe et al. | 455/522 |
| 7,079,044 | B1 | 7/2006 | Stanfield et al. | 340/825.49 |
| 7,081,818 | B2 | 7/2006 | Eckstein et al. | 340/572.1 |
| 7,088,237 | B2 | 8/2006 | Arcens | 340/539.13 |
| 7,089,019 | B2 | 8/2006 | Ormson | 455/456.1 |
| 7,096,034 | B2 | 8/2006 | Zhang et al. | 455/522 |
| 7,098,788 | B2 | 8/2006 | Giraldo et al. | 340/539.25 |
| 7,098,793 | B2 | 8/2006 | Chung | 340/572.1 |
| 7,102,492 | B2 | 9/2006 | Weber | 340/426.1 |
| 7,102,508 | B2 | 9/2006 | Edelstein et al. | 340/539.13 |
| 7,102,509 | B1 | 9/2006 | Anders et al. | 340/539.13 |
| 7,102,510 | B2 | 9/2006 | Boling et al. | 340/539.13 |
| 7,106,189 | B2 | 9/2006 | Burneske et al. | 340/539.13 |
| 7,106,211 | B2 | 9/2006 | Duvall | 340/902 |
| 7,110,776 | B2 | 9/2006 | Sambin | 455/456.1 |
| 7,116,999 | B2 | 10/2006 | Iwamatsu et al. | 455/513 |
| 7,119,687 | B2 | 10/2006 | Paulsen et al. | 340/572.1 |
| 7,120,398 | B2 | 10/2006 | Forrester | 455/114.2 |
| 7,123,149 | B2 | 10/2006 | Nowak et al. | 340/572.1 |
| 7,123,153 | B2 | 10/2006 | Thorstensen et al. | 340/573.3 |
| 7,126,470 | B2 | 10/2006 | Clift et al. | 340/539.13 |
| 7,129,837 | B2 | 10/2006 | Shannon et al. | 340/539.13 |
| 7,136,747 | B2 | 11/2006 | Raney | 701/204 |
| 7,138,913 | B2 | 11/2006 | Mackenzie et al. | 340/539.13 |
| 7,138,914 | B2 | 11/2006 | Culpepper et al. | 340/539.13 |
| 7,142,548 | B2 | 11/2006 | Fong et al. | 370/395.4 |
| 7,142,872 | B2 | 11/2006 | Park et al. | 455/456.1 |
| 7,155,168 | B2 | 12/2006 | McLain et al. | 455/67.11 |
| 7,158,754 | B2 | 1/2007 | Anderson | 455/41.1 |
| 7,162,252 | B2 | 1/2007 | Kennedy, Jr. | 455/456.1 |
| 7,167,676 | B2 | 1/2007 | Ue | 455/13.4 |
| 7,170,407 | B2 | 1/2007 | Wagner | 340/539.13 |
| 7,181,230 | B2 | 2/2007 | Nonoyama et al. | 455/457 |
| 7,187,278 | B2 | 3/2007 | Biffar | 340/539.13 |
| 7,196,621 | B2 | 3/2007 | Kochis | 340/539.13 |
| 7,197,325 | B2 | 3/2007 | Kim | 455/522 |
| 7,197,328 | B2 | 3/2007 | Hart et al. | 455/522 |
| 7,209,075 | B2 | 4/2007 | Durst et al. | 342/357.1 |
| 7,212,829 | B1 | 5/2007 | Lau et al. | 455/456.1 |
| 7,218,227 | B2 | 5/2007 | Davis et al. | 340/572.1 |
| 7,221,270 | B2 | 5/2007 | Chen et al. | 340/539.13 |
| 7,224,963 | B2 | 5/2007 | Anderson et al. | 455/414.3 |

| | | | | |
|---|---|---|---|---|
| 7,224,994 | B2 | 5/2007 | Tayloe et al. | 455/522 |
| 7,225,003 | B2 | 5/2007 | Shoji et al. | 455/575.5 |
| 7,228,228 | B2 | 6/2007 | Bartlett et al. | 701/207 |
| 7,233,805 | B2 | 6/2007 | Choi | 455/522 |
| 7,236,091 | B2 | 6/2007 | Kiang et al. | 340/539.1 |
| 7,236,740 | B2 | 6/2007 | Koo et al. | 455/13.4 |
| 7,236,879 | B2 | 6/2007 | Tsunehara et al. | 701/207 |
| 7,242,953 | B2 | 7/2007 | Al-Housami et al. | 455/522 |
| 7,242,971 | B2 | 7/2007 | Park | 455/574 |
| 7,245,214 | B2 | 7/2007 | Smith | 340/539.13 |
| 7,245,215 | B2 | 7/2007 | Gollu et al. | 340/539.13 |
| 7,245,923 | B2 | 7/2007 | Frank et al. | 455/456.1 |
| 7,248,160 | B2 | 7/2007 | Mangan et al. | 340/539.13 |
| 7,250,860 | B2 | 7/2007 | Smith et al. | 340/539.22 |
| 7,259,668 | B2 | 8/2007 | Casey | 340/539.13 |
| 7,262,687 | B2 | 8/2007 | Nelson | 382/188 |

OTHER PUBLICATIONS

Blue Sky Telemetry-Products-CellTraX, downloaded from www.blueskytelemetry.co.uk on Sep. 26, 2007.

GPS-bird-birdpacks, downloaded from www.environmental-studies.de on Sep. 26, 2007.

Microwave Telemetry, Specifications for 9.5 g Solar Transmitter, downloaded from www.microwavetelemetry.com on Sep. 26, 2007.

μGPS Product available from SirTrack, downloaded from www.sirtrack.com on Sep. 26, 2007.

North Star Science and Technology web page, downloaded from www.northstarst.com on Sep. 26, 2007.

Televilt Tellus Mini, downloaded from www.televilt.se on Sep. 26, 2007.

* cited by examiner

LIGHTWEIGHT PORTABLE TRACKING DEVICE

BACKGROUND OF THE INVENTION

1. Field of the Invention

This invention relates to a portable tracking device and, more particularly, to a method and apparatus for tracking objects that has the ability to utilize multiple communication systems to transmit and receive data relating to the object.

2. Description of the Related Art

Tracking living and non-living mobile objects, assets, or other items is essential to understanding biological and non-biological patterns. Tracking systems that provide various types of data relating to tracked objects are desirable for applications that require non-interrupted visibility of the mobile object through a journey. Existing tracking systems typically employ satellite, radio wave, or other wireless technologies.

Many tracking systems for inanimate objects have been disclosed. U.S. Pat. Nos. 7,196,621 and 7,218,227 disclose tracking systems for aircraft, trucks, vans, automobiles, cargo containers, trailers, busses, trains, locomotives, rail cars, or watercrafts. The tracking systems include a solar powered tracker tag having a tear-drop shaped housing and an antenna. The systems also include a data communication network, a tracking information network, and a GPS satellite constellation.

U.S. Pat. No. 7,236,091 discloses a position-tracking system that includes a tracking device and a host system. The tracking device computes its position within a predetermined area and transmits its position to the host system 18 through a wireless telephone network. The tracking device also includes a power management module.

Several animal tracking systems have also been disclosed. U.S. Pat. No. 7,106,189 discloses such a tracking system that includes a tracking device, a homing station, a communication network, and a manual alignment fixture. The tracking device includes multiple gyroscopes, a magnetic field sensor, signal conditioning and sampling circuitry, and a data processing element. The data processing element sends and receives information through wireless communication. The system does not rely upon GPS.

U.S. Pat. No. 6,498,565 discloses a tracking wireless transceiver for use on vehicles, people, or animals. The transceiver includes an antenna, a power supply, and memory and processor circuits. The transceiver may be used within a cellular telephone system.

U.S. Pat. No. 6,720,879 discloses an animal collar for locating and tracking animals. The collar includes a digital video camera for transmitting real time full motion video signals over a wireless network. The collar also includes a GPS unit.

A lightweight animal tracking device has been disclosed by Microwave Telemetry, Inc. of Columbia, Md. The device is 38 mm×17 mm×12 mm and weighs 9.5 g. The device is solar powered with a temperature sensor. The device utilizes an external antenna to connect to the Argos system to facilitate tracking.

A lightweight animal tracking collar has been disclosed by North Star Science and Technology, LLC in King George, Va. The solar-powered collar weighs 12 g. The collar includes a Globalstar® transmitter coupled to a GPS receiver. The collar communicates with the GPS system through an external antenna.

A mini GPS collar and backpack has been disclosed by Televilt of Lindesberg, Sweden. The collar collects position data utilizing GPS and UHF beacons. The position data can be downloaded to a PC. The collar weighs 60 g.

A collar that utilizes GPS technology and global system for mobile communication (GSM) technology to track animals has been disclosed by Africa Wildlife Tracking of Pretoria, South Africa. The collar utilizes on-board batteries for power.

A GPS/GSM collar for tracking animals has been disclosed by Blue Sky Telemetry of Aberfeldy, Scotland. The collar weighs at least 470 g and utilizes a rechargeable battery for power.

U.S. Pat. No. 4,731,870 discloses a system that is designed for tracking migratory birds. The system includes a platform transmitter terminal that has a solar array, a power supply control/protection means, an encoder, and transmitter means. The power supply control/protection means interfaces with the solar array to ensure that the transmitter means has sufficient power for at least two hours to facilitate communication with an overhead satellite system.

A GPS unit for avian research has been disclosed by Sirtrack of Havelock North, New Zealand. The GPS unit is powered by a rechargeable lithium polymer rechargeable battery. The unit weighs between 22 g to 24 g with dimensions of 45 mm×25 mm×18 mm. The device is attached via a harness, a backpack or glue. The Sirtrack GPS unit collects GPS data, but does not provide for the remote access or remote downloading of data.

A GPS/GSM backpack and harness for tracking large birds has been disclosed by Environmental Studies of Duderstadt, Germany. The backpack is powered by an on-board battery and weighs 155 g.

The typical device that is used to track wildlife is heavy and large. The remaining devices have small memories that limit the frequency of data collection and the amount of data that can be stored and transmitted. These devices are not interactive, do not provide real-time data, and have complex, inefficient, and inflexible software. These devices also have external antennas that cause premature failures. Accordingly, there is a need for an improved tracking device.

SUMMARY OF THE INVENTION

In accordance with the present invention there is provided an apparatus for tracking an object. A processing unit has a memory device. A power management device has a power supply for providing power to the processing unit. A navigational device is provided for receiving position data for the apparatus from a global positioning system. A communication device is provided for communicating with a remote server through a wireless telephone network. A sensor for collecting environmental data for the object is provided. Circuitry connects the power management device, the navigational device, the communication device, and the sensor to the processing unit. The processing unit receives the position data from the navigational device and the environmental data from the sensor. The processing unit converts the position data and the environmental data into information for storage on the processing unit memory device. The processing unit transfers the information to the communications device for transmission over the wireless telephone network to the remote server.

Further in accordance with the present invention, there is provided a portable tracking device. A housing is provided for holding a first internal antenna, a second internal antenna, a processing device, a sensor, and power supply means for providing power to the processing device. The housing is provided for connecting to a mobile object. The processing device has means for connecting to a global positioning system through the first internal antenna to determine the location of the object. The processing device has means for receiving instructions for obtaining input from the sensor from a mobile cellular network through the second internal antenna. The processing device has means for controlling the sensor to obtain input from the sensor. The processing device has means for creating data structures that include the location of the object and the input from the sensor for transmission through the second internal antenna to the mobile cellular network.

Further in accordance with the present invention, there is provided a method for tracking an object. A tracking device is attached to the object. The tracking device is connected to a satellite-based positioning system to obtain the global position of the object. The tracking device is connected to a mobile cellular network to receive signals containing operational commands software from a remote device. The operational commands software is processed to instruct the tracking device to collect environmental data. The global position of the object and the environmental data is transmitted to a server over the mobile cellular network.

Accordingly, a principal object of the present invention is to provide a portable tracking device that obtains global positioning data from a GPS system and transmits the data over a wireless telephone network.

Another object of the present invention is to provide a portable tracking device that transmits the location of the device and environmental data over a cellular telephone network.

Another object of the present invention is to provide a method and apparatus for tracking objects that utilizes a portable tracking device.

A further object of the present invention is to provide a method and apparatus for tracking objects that transmits and receives signals using multiple networks.

These and other objects of the present invention will be more completely described and disclosed in the following specification, accompanying drawings, and appended claims.

DESCRIPTION OF THE PREFERRED EMBODIMENTS

Figure 1:
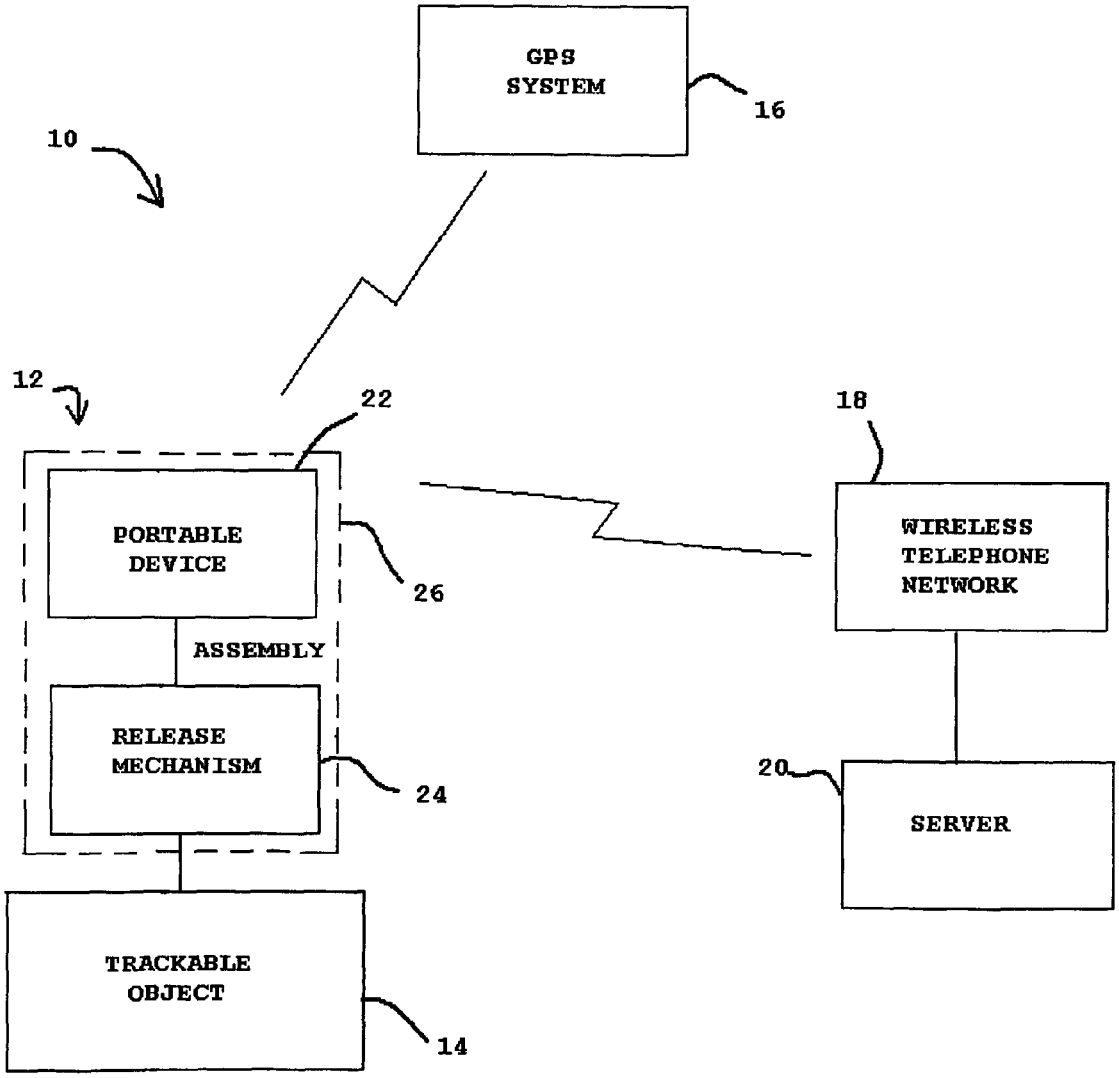
FIG. 1 is a block diagram of a portable tracking device attached to a trackable object positioned within a GPS system and a wireless telephone network.

Referring to the drawings and, particularly, to FIG. 1, there is illustrated a tracking system generally designated by the numeral 10 that utilizes a light weight portable tracking apparatus 12 that attaches to an object 14 to facilitate the tracking of mobile objects while collecting data from those objects. The tracking apparatus 12 has an extended lifespan of between one to three years or longer. The tracking apparatus 12 also has a reduced size, a reduced weight, and the ability to collect images, sounds, and other data from the area surrounding the object 14.

The extended lifespan, reduced size, and reduced weight of the tracking apparatus 12 facilitate the tracking of small objects. Although the tracking apparatus 12 is particularly adapted for tracking birds of prey, the tracking apparatus 12 is also suitable for tracking other birds, other animals, particularly small animals, people, or mobile inanimate objects, such as vehicles or packages.

The tracking apparatus 12 interfaces with a plurality of networks or systems 16, 18 to facilitate the tracking of mobile objects. The system 16 is a satellite-based positioning network, such as a GPS system. The network 18 is a wireless telephone network, preferably a GSM or other mobile cellular telephone network. The tracking apparatus 12 collects data at a high rate and transfers the data via the network 18. The tracking apparatus 12 has the ability to be reprogrammed via the network 18 to provide interactive, real-time tracking and data management.

As illustrated in FIG. 1, the tracking apparatus 12 utilizes the GPS system 16 to determine the global position or fix of the object 14. The GPS system 16 sends a plurality of signals to the tracking apparatus 12. The tracking apparatus 12 includes software that issues internal commands to convert the GPS signals into global position data for the object 14.

The tracking apparatus 12 stores the position data and transmits the data to the wireless telephone network 18. Preferably, the tracking apparatus 12 transmits a data structure containing the data over the network 18 after collecting a pre-determined but interactively reprogrammable amount of data points that depends on network capabilities or parameters of the specific application.

The tracking apparatus 12 utilizes the software to provide the data using a TCP/IP network stack, SMS, or other wireless data communication technologies via a mobile cellular network module, other wireless data networks, a radio network or a satellite network.

The network 18 connects the tracking apparatus 12 to a base station or server 20. The tracking apparatus 12 collects environmental or other information, such as video, audio, geographic location information, altitude, instantaneous movement speed, heading, quality of fix, number of visible satellites, external air temperature, wind speed, unit temperature, light, and other similar information. Sensors may include accelerometers, thermistors, photocell, electronic compass, or other similar components. The tracking apparatus 12 stores the information in memory for transmission to the server 20. Preferably, the wireless telephone network 18 is a GSM network or other mobile cellular network.

The server 20 sends instructions through the wireless telephone network 18 to the tracking apparatus 12. The server 20 has the ability to send a single instruction or multiple instructions to order the tracking apparatus 12 to perform a specific task or function, including changing data collection frequency, reporting status, or other similar functions.

The server 20 includes one or more memory devices (not shown) for storing instructions for reprogramming the tracking apparatus 12. The server 20 sends a set of instructions to reprogram the tracking apparatus 12. The server 20 also has the ability to send software updates, patches, or over-the-air firmware upgrades to the tracking apparatus 12.

The tracking apparatus 12 has the ability to perform troubleshooting or debugging routines. The tracking apparatus 12 connects to the server 20 through the network 18 to provide debugging information to the server 20. Alternatively, the tracking apparatus 12 connects directly to a diagnostic device (not shown) to perform the debugging or troubleshooting routines.

The tracking apparatus 12 stores debugging or troubleshooting information on-board for transmission to the server 20. The information is used in the event of a crash or other anomaly for failure analysis. The tracking apparatus 12 has the ability to send the server 20 a message or a data structure based upon the event.

The tracking apparatus 12 provides basic system health information with location data to the server 20 on a regular basis. The tracking apparatus 12 also has the ability to respond to commands from the server 20 to provide specific debugging information, such as system health information or statistics.

As illustrated in FIG. 1, the tracking apparatus 12 includes a portable device 22 and a magnetic, electric or ultrasonic release mechanism 24. The portable device 22 and the release mechanism 24 are held in an assembly 26 that connects to the object 14. The assembly 26 supports the portable device 22. The release mechanism 24 has the ability to release the assembly 26 from the object 14 in response to a signal from the tracking apparatus 12. The dimensions and structure of the release mechanism 24 are selected to meet the objectives of a particular application.

The portable device 22 includes software that signals the release mechanism 24 to release the assembly 26 at a predetermined time period or in response to an instruction from the server 20 or mobile cellular handset (not shown). The instructions are text messages, SMS messages, or other similar server commands.

The software has the ability to fire the release mechanism 24 immediately. Alternatively, the software delays the firing of the release mechanism 24 until a particular time or upon reaching a specific destination or altitude, which facilitates recovery of the tracking apparatus 12.

Once the software actuates the release mechanism 24 to drop the tracking apparatus 12, the software transmits through the network 18 that the drop was successful. The software also transmits the time at which the drop occurred. Optionally, the tracking system 22 has the ability to emit a periodic or continuous loud sound after being dropped from the object 14 to enable one to recover the dropped tracking apparatus.

Figure 2:
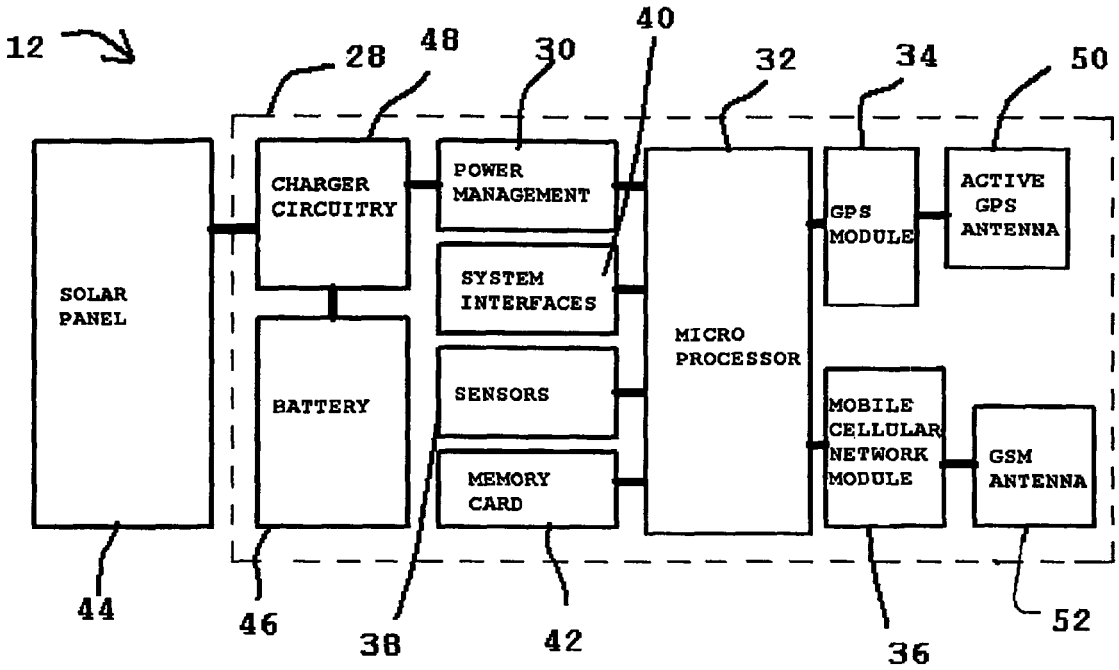
FIG. 2 is a block diagram of another embodiment of the invention that includes multiple modules for connecting to a GPS system and a wireless telephone network.

Referring now to FIG. 2, the tracking apparatus 12 includes an external housing or case 28 that holds a power management device 30, a processing unit or microprocessor 32, a navigational device 34, a communication device 36, a plurality of sensors 38, and a plurality of system interfaces 40. The processing unit 32 controls the power management device 30, the sensors 38, the navigational device 34, the communication device 36 to perform functions related to collecting data, storing data, receiving instructions, and sending instructions.

The power management device 30, the processing unit 32, the navigational device 34, the communication device 36, the sensors 38, and the system interfaces 40 are connected to one another and mounted within the housing 28 through any suitable means. Preferably, the processing unit 32 is mounted on a printed circuit board and connected to the power management device 30, the navigational device 34, the communication device 36, and the sensors 38 with circuitry.

The processing unit 32 controls the power management device 30, the sensors 38, the navigational device 34, and the communication devices 36. The processing unit 32 utilizes the navigational device 34 to connect to the system 16 shown in FIG. 1 and the communication device 36 to connect to the network 18 shown in FIG. 1. The navigational device 34 links to the system 16 to obtain a plurality of GPS signals that are used to determine the global position of the apparatus 12.

The communication device 36 links to the network 18 to transmit and receive data and instructions. The communication device 36 has the ability to receive a plurality of instructions through the network 18 to reprogram the processing unit 32. Preferably, the processing unit 32 includes a microprocessor and a printed circuit board that comprises circuitry to regulate charging through the power management device 30, to output data, and to debug the software stored thereon.

The processing unit 32 has the ability to receive the instructions from the network 18 and to store those instructions in a memory device 42. The processing unit 32 has the ability to transfer data stored in the memory device 42 to the network 18. Preferably, the memory device 42 is a flash memory drive or other similar device.

The processing unit 32 has the ability to utilize the instructions from the network 18 to send commands to the power management device 30, the sensors 38, or the system interfaces 40. The memory device 42 has at least three megabytes of storage. Preferably, the memory device 42 includes an expansion SD card having multiple gigabytes of storage and the system interfaces 40 include a built-in serial port.

The processing unit 32 instructs the sensors 38 to collect data at a user-defined interval. Conventional tracking devices collect data at a maximum interval of one hour. The processing unit 32 and sensors have the ability to collect data at any user-defined rate up to continuous speeds, such as one hour, one minute, thirty seconds, one second or faster. Preferably, the rate depends upon the maximum capacity of the GPS unit.

The processing unit 32 has a default rate for collecting data set. Alternatively, the processing unit 32 also has multiple user-defined and date-dependent alternative data collection rates. The server 20 shown in FIG. 1 has the ability to change the default rate via the network 18.

As illustrated in FIG. 2, the processing unit 32 connects to the system interfaces 40. The system interfaces 40 facilitate direct connection of the processing unit 32 to an external system or device (not shown), such as a diagnostic system for performing troubleshooting operations.

The processing unit 32 also connects to the power management device 30 to receive power. The power management device 30 is part of a power management system that includes an optional solar panel 44, a power supply 46, and charger 48. Within the power management system, the solar panel 44 collects solar energy and transfers the power to the power supply 46 for storage. Preferably, the power supply 46 includes a rechargeable battery and the power management device 30 includes circuitry for managing power.

As illustrated in FIG. 2, the power management device 30 controls the collection of power through the solar panel 44. The solar panel 44 is positioned outside of the housing 28. Preferably, the solar panel 44 is positioned on top of the housing 28.

The power management device 30 controls the flow of power into and out of the power supply 46 through the charger 48. The processing unit 32 utilizes software routines to control the power management device 30, which controls the solar panel 44 and the power supply 46 to optimize power usage by the tracking apparatus 12. Preferably, the charger 48 includes circuitry to direct the flow of power from the solar panel 44 to the power supply 42.

The power management device 30 manages the power levels in the power supply 46 to maintain power at an optimal level. The power management device 30 instructs the processing device 32 to stop transmitting data when the power supply 42 contains insufficient power to allow the tracking apparatus 12 to continue to function.

The power management device 30 also has the ability to disable the tracking apparatus 12 when the power level is too low. Once the tracking apparatus 12 is disabled, the solar panel 44 continues to collect power until the power supply or battery 46 collects enough power to allow the tracking apparatus 12 to function normally. Optionally, the power management device 30 has the ability to shut down the tracking apparatus 12 between data collection intervals to conserve power. The power management device 30 uses the sensors 38, which include light sensitive photo cells, to determined an appropriate shutdown routine.

As illustrated in FIG. 2, the navigational device 34 includes a GPS module for connecting to the system 16 shown in FIG. 1. The navigational device 34 connects to the system 16 through a GPS antenna 50 to receive a plurality of GPS signals from the system 16. The communication device 36 utilizes the GPS signals to determine the location of the apparatus 12. Alternatively, the processing unit 32 utilizes the GPS signals to determine the location of the apparatus 12.

As illustrated in FIG. 2, the communication device 36 includes a mobile cellular network module for connecting to the network 18 shown in FIG. 1. The communication device 36 connects to the network 18 through an internal antenna 52 positioned within the housing 28 for protection. The communication device 36 facilitates the transfer of data and instructions from the processing unit 32 and the network 18.

The antenna 52 is an internal antenna. The antenna 50 is positioned within the housing 28 for protection. The use of an internal antenna extends the life of the apparatus 12 over conventional tracking devices that use external antennas because external antennas are often the primary point of failure for such devices.

The processing unit 32 controls the sensors 38 to collect various types of information about the external environment of the object 14. The information includes images, sounds, temperatures, or other measurements of environmental conditions. The sensors 38 convert the information into data, such as video, audio, photographs, or other data structures for storage in the memory device 42.

The sensors 38 include a plurality of suitable sensors, such microphones, video cameras, or other sensors. The microphone is a built-in internal microphone or an external microphone for collecting audio. The video camera is a built-in internal camera or an external camera. Optionally, these sensors include start/stop triggers based upon audio, speed, light or other threshold levels.

The tracking apparatus 12 has the ability to broadcast audio, video, or other sensor data over the network 18 shown in FIG. 2. The data is provided in real-time, near real-time, live, or is stored in the memory device 42 for later transmission.

As illustrated in FIG. 2, the processing unit 32 utilizes specialized software to reduce power consumption, which allows the tracking apparatus 12 to use a smaller power supply 46. The tracking apparatus 12 utilizes the customized software to turn on and to collect data at a user-defined rate. The software automatically manages power for each data collection cycle. The software also transmits data via the networks 16, 18 shown in FIG. 1 at user-defined, pre-defined adjustable intervals.

The processing unit 32 utilizes the customized software to directly communicate with the wireless telephone network 22 shown in FIG. 1 at any time to determine the location of the object 14 or to upload new software or run debugging programs. Preferably, the processing unit 32 contacts a mobile telephone (not shown) through the server 20 on the wireless network (not shown).

The processing unit 32 or the server 20 includes software that determines when the tracking apparatus 12 is not functioning correctly. Once the software determines that the tracking apparatus 12 is not functioning correctly, the software automatically notifies the user and activates a "safe" mode. In the safe mode, the tracking apparatus processing unit 32 utilizes the software to collect data and store the data in the memory device 42, while trying to contact the user.

As illustrated in FIGS. 1-2, the tracking apparatus 12 has many additional features that provide reduced weight, reduced size, and an extended lifespan. The tracking apparatus 12 has a plurality of miniaturized components, including the processing unit 32, the navigational device 34, the communication device 36, the sensors 38, the system interfaces 40, the solar panel 44, and the power supply 46. The use of miniaturized components allows the device to weigh less than 100 g (0.20 lbs) with dimensions of less than 45 mm×45 mm×35 mm.

Figure 3:
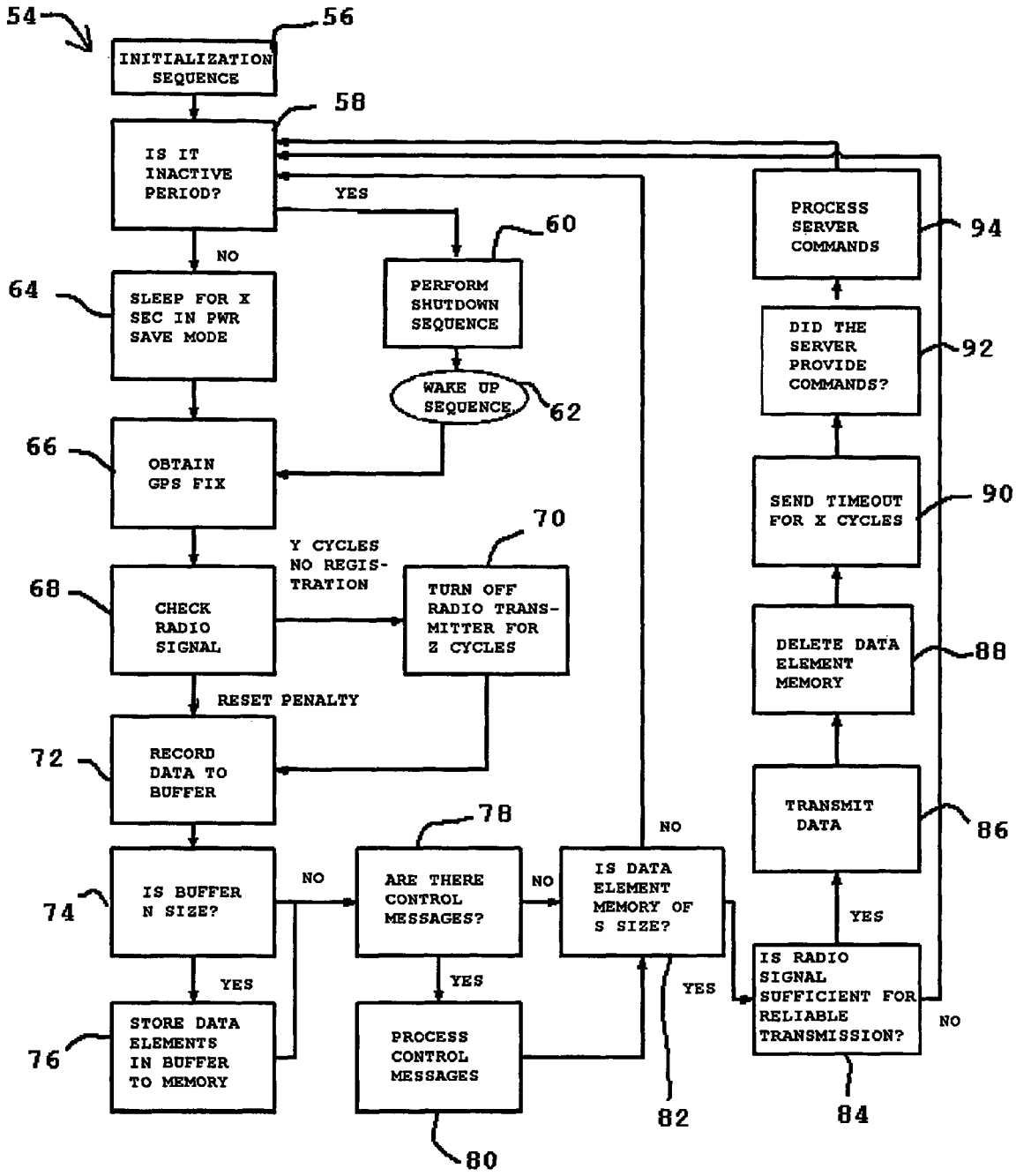
FIG. 3 is a flow chart for a software program that controls the operation of the invention.

Referring now to FIGS. 1-3, the processing unit 32 performs a series of steps to collect data and to transfer the data to the server 20. The processing unit 32 includes software that performs a series of instructions in accordance with the algorithm 54 shown in FIG. 3. Preferably, the algorithm 54 is written in a software code and compiled for use by the microprocessor 32.

The first step 56 in the algorithm 54 is an initialization sequence in which the power management device 30 allows power to flow from the power supply 46 into the processing unit 32. The next step 58 is a checking step in which the processing unit 32 communicates with the sensors 38 to determine whether it is inactive period, such as night time, in the area immediately surrounding the object 14 shown in FIG. 1.

In the event that the sensors 38 determine that it is an inactive period, the processing unit 32 directs the power management device 30 to perform a shutdown routine 60. The shutdown routine 60 allows the tracking apparatus 12 to perform a hibernation sequence.

The apparatus 12 continues to hibernate until the sensors 38 determine that a predetermined event has occurred, such as the arrival of morning or some other predetermined time period. After the sensors 38 determine that the predetermined event has occurred, the processing unit 32 directs the power management device 30 to perform wake up routine.

As illustrated in FIG. 3, the processing unit 32 has the ability to perform a sleep routine 64 for a predetermined time period when the apparatus 12 is in a power saving or "sleep" mode. The sleep routine 64 provides additional power savings, which is a factor in the extended life span of the apparatus 12. The processing unit 32 has the ability to activate or deactivate the sleep routine 64 at a particular time of day, at sunset, at sunrise, or based upon geographic position as calculated by the on-board GPS unit 34.

Referring now to FIGS. 1-3, the processing unit 32 performs a locating step 66 by obtaining a GPS fix from the GPS system 16 shown in FIG. 1 after completing the shutdown routine 60 or the sleep routine 64. After obtaining the GPS fix, the processing unit 32 performs a cycle of steps that includes a signal checking step 68, a timeout step 70, and a recording step 72.

The processing unit 32 instructs the mobile cellular network communication device 36 to perform the signal checking step 68 by determining whether the wireless telephone network 18 has sufficient signal strength to send and receive data to the server 20. In the event that the processing unit 32 determines that the signal is insufficient after a predetermined number of cycles, the processing unit 32 instructs the communication device 36 to perform a timeout step 70 for a predetermined number of cycles.

As illustrated in FIG. 3, the processing unit 32 performs the recording step 72 after performing the signal checking step 68 and, if necessary, the timeout step 70. During the recording step 72, the processing unit 32 records the location data from the GPS system 16 into a suitable data structure, such as an array.

The processing unit 32 continues the cycle of signal checking 68, timeout 70, and recording 72 until a predetermined number of locations are stored in the array, as indicated by step 74. Once processing unit 32 stores a predetermined number of locations, the processing unit 32 saves the location data in a file 76 in the memory device 42.

As illustrated by FIGS. 1-3, the server 20 has the ability to send the processing unit 32 instructions. The processing unit 32 performs a checking step 78 utilizing the communication device 36 to connect with the network 18 to determine whether there are any messages or instructions. The messages or instructions are in any suitable format, including in the format of SMS or "text" messages.

The processing unit 32 processes the message in a message processing step 80. After processing the message, the processing unit 32 performs another checking step 82 to determine whether a data element or structure in the memory device 42 is of sufficient size to send to the server 20. The processing unit 32 also checks to determine whether the communication device 36 has a sufficient connection with the network 18 to send the data to the server 20 in step 84.

The processing unit 32 will perform a transmission step 86 to transmit or send the data to the server 20. The processing unit 32 measures the signal strength of the interface between the tracking apparatus 12 and the wireless telephone network 18 before transmitting the data to the server 20.

As shown in FIGS. 1-3, the processing unit 32 transmits the data to the server 20 after the signal strength exceeds a predetermined level and after determining that there is sufficient data in the memory device 42. If the transmission is successful, the processing unit 32 will perform a memory purge step 88 to delete the data element or structure to conserve memory in the memory device 42.

If the transmission is unsuccessful, the processing unit 32 will continue to instruct the communication device 36 to attempt to connect to the network 18 for a predetermined number of cycles. Upon failure of the transmission or after a predetermined period of time, the processing unit 32 will perform a timeout step 90 by sending a suitable message to the network 18 or recording the event in the memory device 42.

As illustrated in FIG. 3, the processing unit 32 performs a pair of additional processing steps 92, 94 on the message that is received from the network 18 to process instructions from the server 20. In the first processing step 92, the processing unit 32 reviews the message to determine whether the message includes any instructions from the server 20.

In the second processing step 94, the processing unit 32 executes the instructions to utilize the sensors 38 to perform various data collection functions. Optionally, the processing unit 32 stores the instructions in the memory device 42 for later execution. Preferably, the memory device 42 has sufficient memory to store a sufficient number of instructions to reprogram the processing unit 32.

Figure 4:
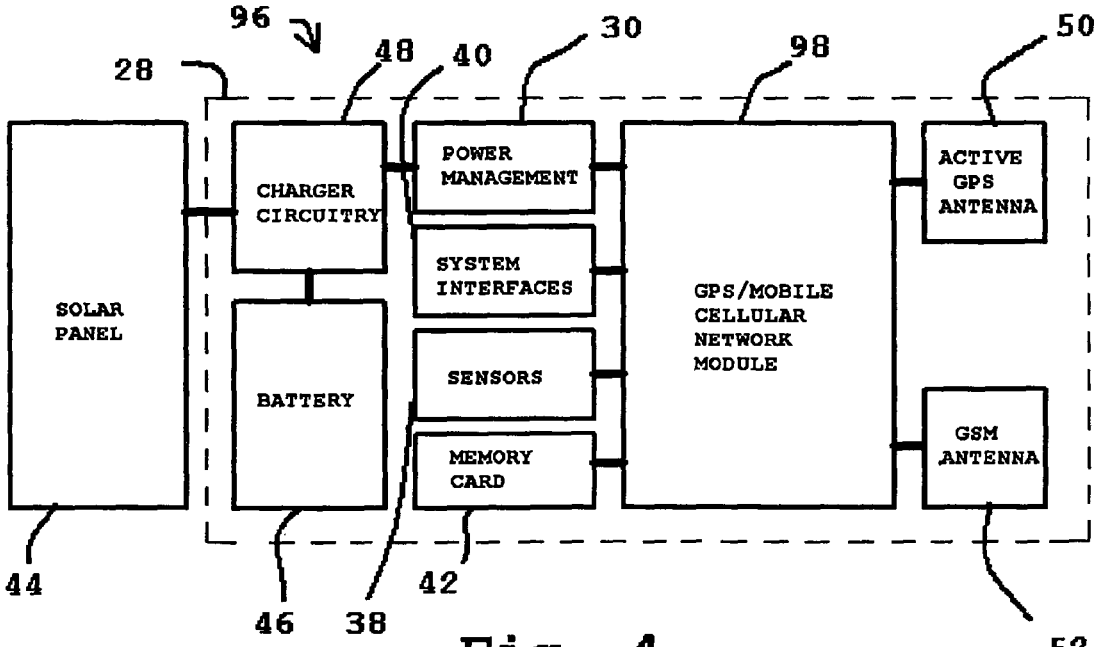
FIG. 4 is a block diagram of an embodiment of the invention that includes a single module for connecting to a GPS system and a wireless telephone network.

Referring now to FIG. 4, there is shown another embodiment of a tracking apparatus generally designated by the numeral 96, in which like elements are identified by like numerals shown in FIGS. 1-3. The tracking apparatus 96 includes a single module 98 that includes a microprocessor, mobile cellular network module, and GPS module integrated into a single component mounted on a printed circuit board.

The microprocessor of module 98 performs all of the functions of the processing unit 32 shown in FIG. 2. A pair of internal devices in module 98 performs all of the functions of the navigational device 34 and the communication device 36 shown in FIG. 2. Preferably, the module 98 is a cellular quad band module with a software processor. The module 98 has both cellular communication capability and GPS capability.

The module 98 includes a mobile cellular network module, a GPS module, and a microprocessor for instructing the power management device 30, the sensors 38, and the interfaces 40. The module 98 utilizes the integrated GPS module to obtain GPS signals from the GPS system 16 shown in FIG. 1 through the antenna 50. The module 98 also utilizes the integrated mobile cellular network module to send and receive data from the wireless telephone network 18 shown in FIG. 1 through the antenna 52.

Figure 5:
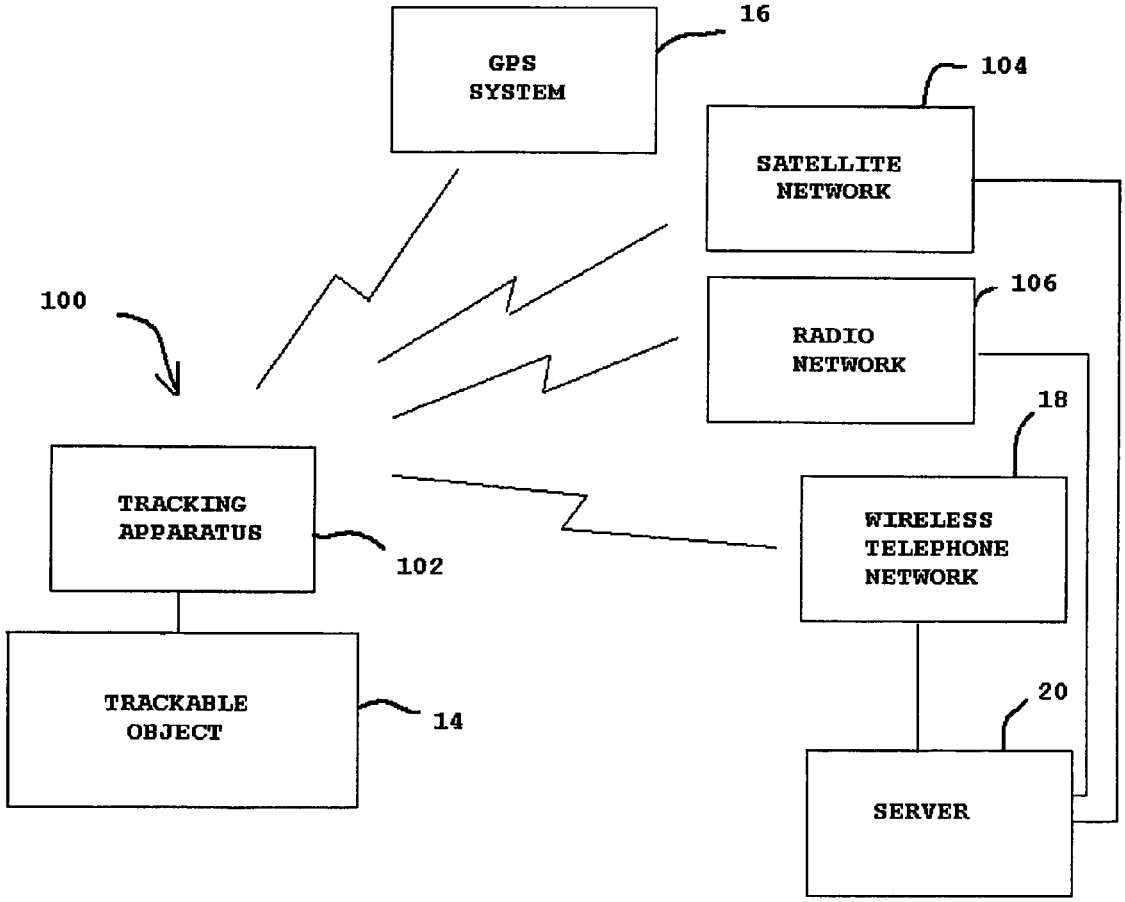
FIG. 5 is a block diagram of another embodiment of a portable tracking device attached to a trackable object positioned within GPS system, wireless telephone network, and a broadcast network.
Figure 6:
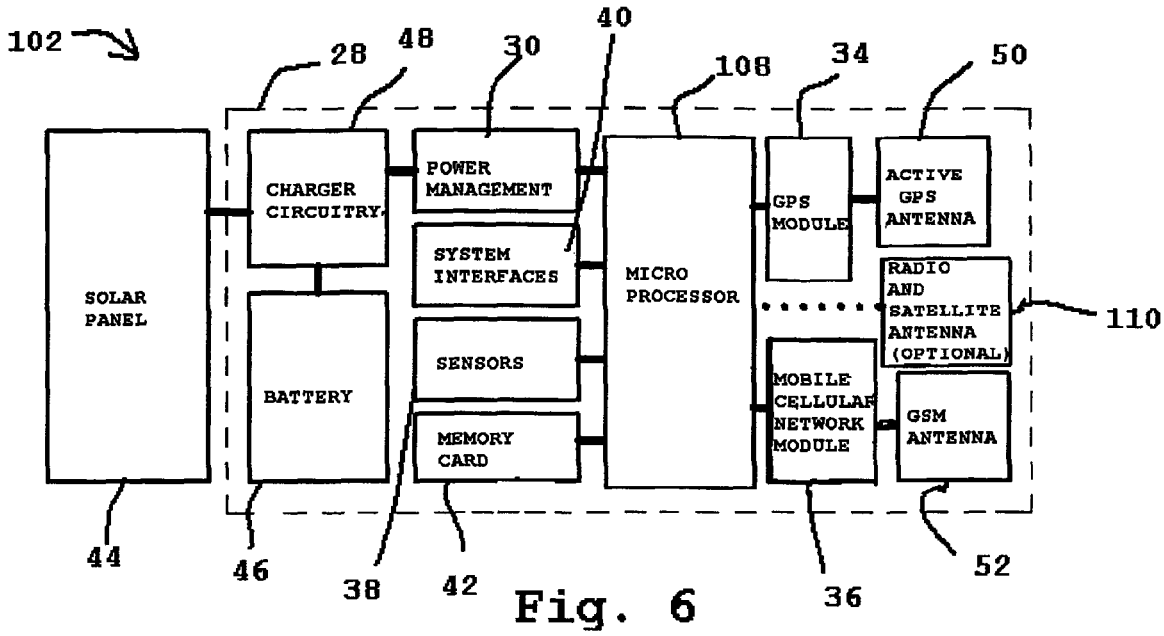
FIG. 6 is a block diagram of another embodiment of the invention that includes a single module for connecting to a GPS system, a wireless telephone network, and an optional broadcast network.

Referring now to FIGS. 5-6, there is shown another embodiment of a tracking system generally designated by the numeral 100, in which like elements are identified by like numerals shown in FIGS. 1-4. The tracking system 100 includes a tracking apparatus 102 that interfaces with a GPS system 16, a mobile cellular network 18, and a pair of broadcast networks 104, 106. The network 104 is a satellite broadcasting network. The network 106 is a radio network.

The tracking apparatus 102 includes a housing 28 that holds a power management device 30, a processing device 108, a navigational device 34, a communication device 36, a plurality of sensors 38, a plurality of system interfaces 40, and a pair of internal antennas 50, 52. Unlike the embodiments shown in FIGS. 1-4, the tracking apparatus 102 includes a third internal antenna 110 for connecting to the networks 104, 106. The processing device 108 is connected to the internal antenna 110 to send and receive data over the networks 104, 106.

Figure 7:
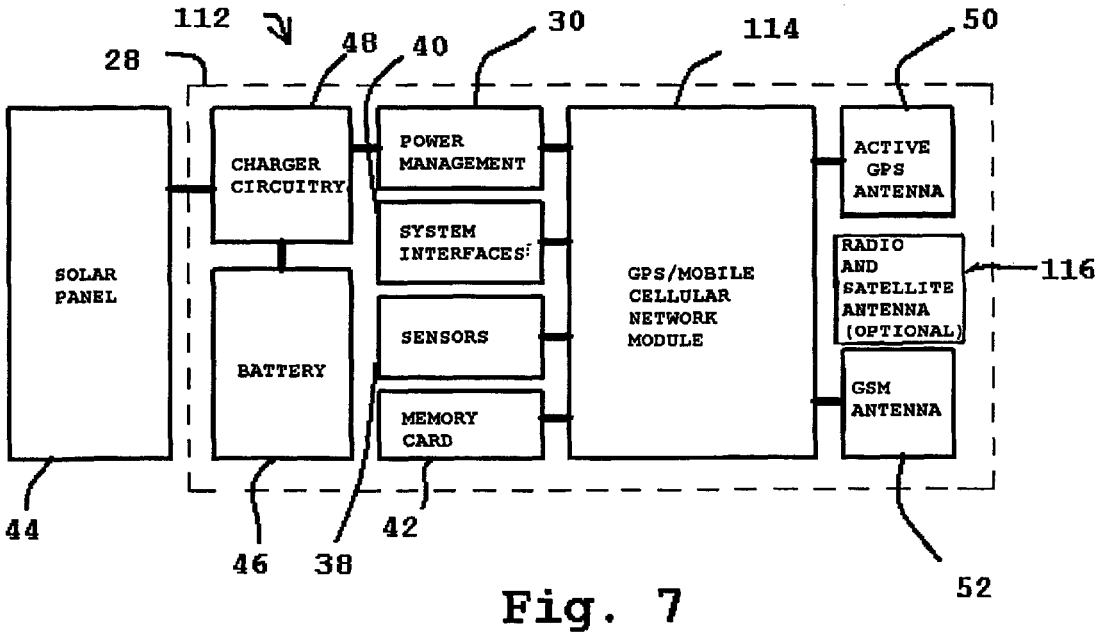
FIG. 7 is a block diagram of another embodiment of the invention that includes multiple modules for connecting to a GP system, a wireless telephone network, and an optional broadcast network.

Referring now to FIG. 7, there is shown another embodiment of a tracking apparatus generally designated by the numeral 112, in which like elements are identified by like numerals shown in FIGS. 1-6. The tracking apparatus 112 includes a housing 28 that holds a power management device 30, a module 114, a plurality of sensors 38, a plurality of system interfaces 40, and a pair of antennas 50, 52. The module 114 has the ability to interface with the networks 16, 18, 102, 104 shown in FIG. 5. The module 114 communicates with the networks 102, 104 through a third internal antenna 116.

It should be understood that alternative embodiments are contemplated in accordance with the present invention and include embodiments in which the networks 18, 104, 106 shown in FIG. 5 connect to separate servers, computers, memory devices, or other similar devices.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. An apparatus for tracking an object comprising:

a processing unit having a memory device, a power management device connected to said processing unit and having a power supply for providing power to said processing unit, a navigational device connected to said processing unit for receiving position data for the apparatus from a global positioning system, a communication device connected to said processing unit for communicating with a remote server through a wireless telephone network, a sensor connected to said processing unit for collecting environmental data for the object, said power management device, said navigational device, said communication device, and said sensor electronically connected in a circuit to said processing unit within a housing, said processing unit receiving the position data from said navigational device and the environmental data from said sensor, said processing unit converting the position data and the environmental data into information for storage on said processing unit memory device, and said processing unit transferring the information separately from storing the information to said communication device for transmission over the wireless telephone network to the remote server.

2. An apparatus as set forth in claim 1 in which:

said navigational device includes a first internal antenna for connecting to the global positioning system, and said communication device includes a second internal antenna for connecting to the wireless telephone network.

3. An apparatus as set forth in claim 2 in which:

a third internal antenna for communicating with a broadcast network selected from the group consisting of a radio network and a satellite network.

4. An apparatus as set forth in claim 1 which includes:

the remote server storing instructions for the operation of the apparatus, said communications device receiving the instructions from the remote server, and said communications device transferring the instructions to said processing unit.

5. An apparatus as set forth in claim 4 in which:

said processing unit memory device includes software for controlling the apparatus, and said communications device receives the instructions from the remote server to update said processing unit memory device software.

6. An apparatus as set forth in claim 1 which includes:

a solar panel for collecting power connecting to said power supply, said power supply having a rechargeable battery, and said power management device controlling said solar panel and said power supply to optimize power consumption.

7. An apparatus as set forth in claim 1 which includes:

said navigational device having a GPS module for interfacing with the global positioning system, and said communication device having a mobile cellular network module for interfacing with the wireless telephone network.

8. An apparatus as set forth in claim 1 which includes:

said sensor collecting environmental data selected from the group consisting of audio, video, geographic location information, photographic, light, relative air movement, absolute air movement, external temperature and internal temperature.

9. An apparatus as set forth in claim 1 which includes:

a plurality of said sensors for collecting environmental data.

10. An apparatus as set forth in claim 1 in which:

said processing unit includes means for storing a predetermined amount of data in said memory device before transmitting the data to the remote server.

11. An apparatus as set forth in claim 1 which includes:

said communication device forming a connection to the wireless telephone network, said processing unit having means for measuring the signal strength of the connection between said communication device and the wireless telephone network before transmitting the data to the remote server, and said processing unit having means for transmitting the data to the remote server after the signal strength exceeds a predetermined level.

12. An apparatus as set forth in claim 1 which includes:

means for releasably connecting said apparatus to the object, and means for effecting the release of said apparatus from the object.

13. An apparatus as set forth in claim 1 which includes:

the wireless telephone network being a cellular telephone network.

14. An apparatus as set forth in claim 1 in which:

said memory device includes means for storing a plurality of the instructions from the remote server for reprogramming the processing unit.

15. An apparatus as set forth in claim 1 in which:

said processing unit, said navigational device, and said communication device are integrated into a single module.

16. An apparatus as set forth in claim 1 in which:

said processing unit includes means for obtaining a measurement of the amount of power stored in said power supply and means for deactivating the apparatus in response to the power supply measurement.

17. An apparatus as set forth in claim 16 which includes:

means for writing the position and environmental information on said processing unit memory device in response to the power supply measurement.

18. An apparatus as set forth in claim 17 in which:

said power management device includes means for recharging said power supply, and said processing device includes means for reactivating said apparatus to transmit the position and environmental information over the wireless telephone network to the remote server after said power supply measurement exceeds a predetermined level.

19. A portable tracking device comprising:

a housing for holding a first internal antenna, a second internal antenna, a processing device, a sensor, and power supply means for providing power to said processing device, said housing for connecting to a mobile object, said processing device having means for connecting to a global positioning system through said first internal antenna to determine the location of the object, said processing device having means for receiving instructions for obtaining input from said sensor from a mobile cellular network through said second internal antenna, said processing device having means for controlling said sensor to obtain input from said sensor, said processing device having means for creating data structures that include the location of the object and the input from said sensor for transmission through said second internal antenna to the mobile cellular network, and said processing device having means for obtaining a measurement of the amount of power stored in said power supply means for deactivating said processing device in response to management of the supply of power thereto.

20. A portable tracking device as set forth in claim 19 in which:

means for charging said power supply means.

21. A portable tracking device as set forth in claim 19 which includes:

a third internal antenna for communicating with a network selected from the group consisting of a radio network and a satellite network.

22. A portable tracking device as set forth in claim 19 in which:

said processing device includes at least one module selected from the group consisting of a GPS module, a mobile cellular network module, and a GPS/mobile cellular network module.

23. A portable tracking device as set forth in claim 19 which includes:

said processing device having means for transmitting the data structures to the mobile cellular network after the data structure exceeds a predetermined size.

24. A portable tracking device as set forth in claim 19 in which:

said processing device includes means for linking to the mobile cellular network, means for measuring the signal strength of the link to the mobile cellular network, and means for determining whether the signal strength exceeds a predetermined limit and for thereafter transmitting the data structure through the mobile cellular network if the signal strength exceeds the limit.

25. A portable tracking device as set forth in claim 19 in which:

a plurality of said sensors, and each sensor includes means for collecting environmental data.

26. A portable tracking device as set forth in claim 19 which includes:

said sensor collecting environmental data selected from the group consisting of audio, video, geographic location information, photographic, light, relative air movement, absolute air movement, external temperature and internal temperature.

27. A portable tracking device as set forth in claim 19 which includes:

means for monitoring said power supply means to determine the amount of power stored therein, and means for deactivating said processing device after the amount of power stored in said power supply means reaches a predetermined minimum threshold.

28. A portable tracking device as set forth in claim 27 which includes:

means for storing the data structure on said processing device before the amount of power stored in said power supply means reaches a predetermined minimum threshold.

29. A portable tracking device as set forth in claim 28 which includes:

means for recharging said power supply means, means for reactivating said processing device to transmit the data structure from said means for storing the data structures on said processing device to said remote server after the amount of power stored in said power supply means exceeds the predetermined minimum threshold.

30. A method for tracking an object comprising the steps of:

attaching a tracking device to the object, connecting the tracking device to a satellite-based positioning system to obtain the global position of the object, connecting the tracking device to a mobile cellular network to receive signals containing operational commands software from a remote device, processing the operational commands software to instruct the tracking device to collect environmental data, and transmitting the global position of the object and the environmental data to a server over the mobile cellular network.

31. A method as set forth in claim 30 which includes:

sending signals containing programming software from the remote device to the tracking device, and processing the programming software to reprogram the tracking device.

32. A method as set forth in claim 30 which includes:

storing power on a power storage system on the tracking device, and monitoring the power stored on the tracking device to determine when the stored power reaches a predetermined minimum threshold.

33. A method as set forth in claim 32 which includes:

recording the global position of the object in a first data structure, recording the environmental data in a second data structure, turning off the sensor when the stored power reaches that threshold, and disconnecting the tracking device from the satellite-based-positioning system and the wireless telephone network when the stored power reaches that threshold.

34. A method as set forth in claim 33 which includes:

storing the first data structure and the second data structure in a memory device on the tracking device, deactivating the tracking device when the stored power reaches the threshold, recharging the tracking device, and reactivating the tracking device to transmit the first data structure and the second data structure to the server over the mobile cellular network.

35. A method as set forth in claim 31 which includes:

recharging the tracking device power storage system to a predetermined reactivation threshold, activating the sensor, and reconnecting the tracking device to the satellite-based positioning system and the mobile cellular network.

36. A method as set forth in claim 30 which includes:

recording the global position of the object in a data structure, recording the environmental data in the data structure, monitoring the size of the data structure to determine when the data structure includes a predetermined amount of data, and transmitting the data structure to the server over the mobile cellular network after the data structure includes the predetermined amount of data.

37. A method as set forth in claim 30 which includes:

recording the global position of the object in a data structure, recording the environmental data in the data structure, measuring the signal strength of the connection between the tracking device and the mobile cellular network, and transmitting the data structure to the server over the mobile cellular network after the signal strength exceeds a predetermined size.

38. A method as set forth in claim 30 which includes:

connecting to the satellite-based positioning system through a first internal antenna, and communicating with the mobile cellular network through a second internal antenna.

39. A method as set forth in claim 30 which includes:

sending a plurality of instructions through the mobile cellular network to reprogram the tracking device.

* * * * *